US012359894B2

(12) United States Patent
Zinas et al.

(10) Patent No.: US 12,359,894 B2
(45) Date of Patent: Jul. 15, 2025

(54) USING ELECTROMAGNETICALLY REINFORCED COMPRESSED FERROMAGNETIC POWDER

(71) Applicants: Andreas Zinas, Athens (GR); Vasilios Zinas, Athens (GR); Leonidas Karakatsanis, Xanthi (GR)

(72) Inventors: Andreas Zinas, Athens (GR); Vasilios Zinas, Athens (GR); Leonidas Karakatsanis, Xanthi (GR)

( * ) Notice: Subject to any disclaimer, the term of this patent is extended or adjusted under 35 U.S.C. 154(b) by 0 days.

(21) Appl. No.: 17/925,337

(22) PCT Filed: May 31, 2021

(86) PCT No.: PCT/GR2021/000036
§ 371 (c)(1),
(2) Date: Nov. 21, 2022

(87) PCT Pub. No.: WO2021/245433
PCT Pub. Date: Dec. 9, 2021

(65) Prior Publication Data

US 2023/0194213 A1 Jun. 22, 2023

(30) Foreign Application Priority Data

Jun. 5, 2020 (GR) ..... 20200100322

(51) Int. Cl.
*F41H 5/007* (2006.01)
*F41H 5/04* (2006.01)

(52) U.S. Cl.
CPC ..... *F41H 5/007* (2013.01); *F41H 5/0457* (2013.01)

(58) Field of Classification Search
CPC ..... F41H 5/007; F41H 5/00–266
See application file for complete search history.

(56) References Cited

U.S. PATENT DOCUMENTS

| | | | | |
|---|---|---|---|---|
| 6,622,608 | B1 * | 9/2003 | Faul | B82Y 25/00 89/36.02 |
| 7,946,211 | B1 * | 5/2011 | Winchester | B29C 70/70 89/902 |
| 2004/0118273 | A1 * | 6/2004 | Zank | F41H 5/007 89/36.17 |
| 2009/0199701 | A1 * | 8/2009 | Wickert | F41H 5/007 89/36.02 |
| 2010/0083428 | A1 * | 4/2010 | McElroy | F41H 1/02 2/456 |
| 2013/0213211 | A1 * | 8/2013 | Fisher | F41H 5/007 252/372 |
| 2013/0284003 | A1 * | 10/2013 | Dodworth | F41H 5/0428 428/116 |

(Continued)

FOREIGN PATENT DOCUMENTS

| | | | |
|---|---|---|---|
| KR | 101312320 | B1 * | 9/2013 |
| KR | 102291409 | B1 * | 8/2021 |
| WO | WO-2018104755 | A1 * | 6/2018 |

*Primary Examiner* — Gabriel J. Klein

(57) ABSTRACT

This invention relates to a dynamic armor system for tanks and battle vehicles using compressed ferromagnetic powder that is electromagnetically reinforced. The system is enhanced with a three-level structure: a high-temperature silicone layer, distributed ferromagnetic powder in geometric shapes, and an explosive layer activated by sensors. This combination improves the armor's resistance to modern anti-tank projectiles.

6 Claims, 5 Drawing Sheets

(56) References Cited

U.S. PATENT DOCUMENTS

| | | | | |
|---|---|---|---|---|
| 2016/0273885 | A1* | 9/2016 | Broussard, Jr. | G01S 17/66 |
| 2019/0289681 | A1* | 9/2019 | Matsen | H05B 6/101 |
| 2021/0341260 | A1* | 11/2021 | Beckman | F41H 5/007 |
| 2023/0194213 | A1* | 6/2023 | Zinas | F41H 5/007 89/36.17 |

* cited by examiner

USING ELECTROMAGNETICALLY REINFORCED COMPRESSED FERROMAGNETIC POWDER

BACKGROUND OF THE INVENTION

Field of the Invention

This invention relates to dynamic armor systems for military vehicles, specifically using compressed ferromagnetic powder that is electromagnetically reinforced to improve the durability of tanks and other battle vehicles against anti-tank projectiles.

Description of Related Art

Modern tank armor systems are built using complex materials, including metals and composite alloys, to withstand penetration by high-velocity projectiles. However, advancements in anti-tank weaponry have outpaced traditional armor systems. The invention provides a novel three-level reinforcement system for enhancing protection.

DETAILED DESCRIPTION OF THE INVENTION

Figure 1:
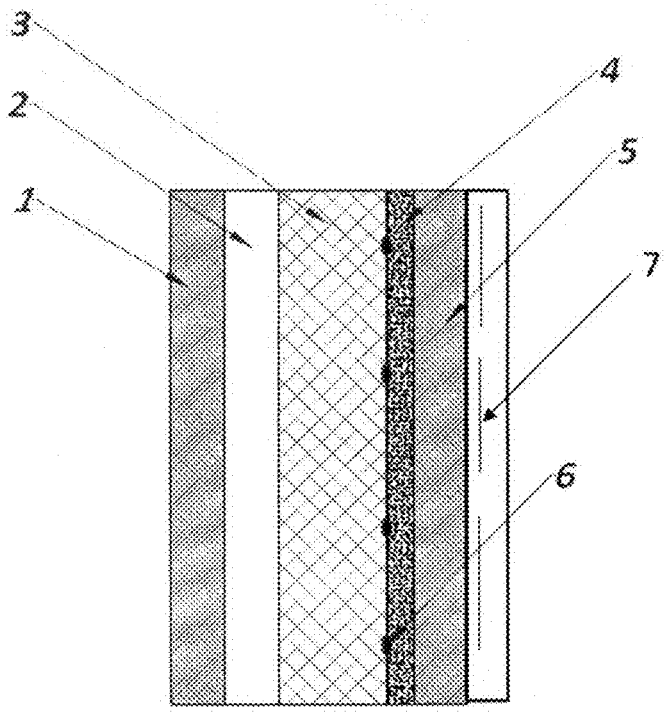
FIG. 1: A cross-sectional magnified view of the modified dynamic armor system layers for a tank.
Figure 2:
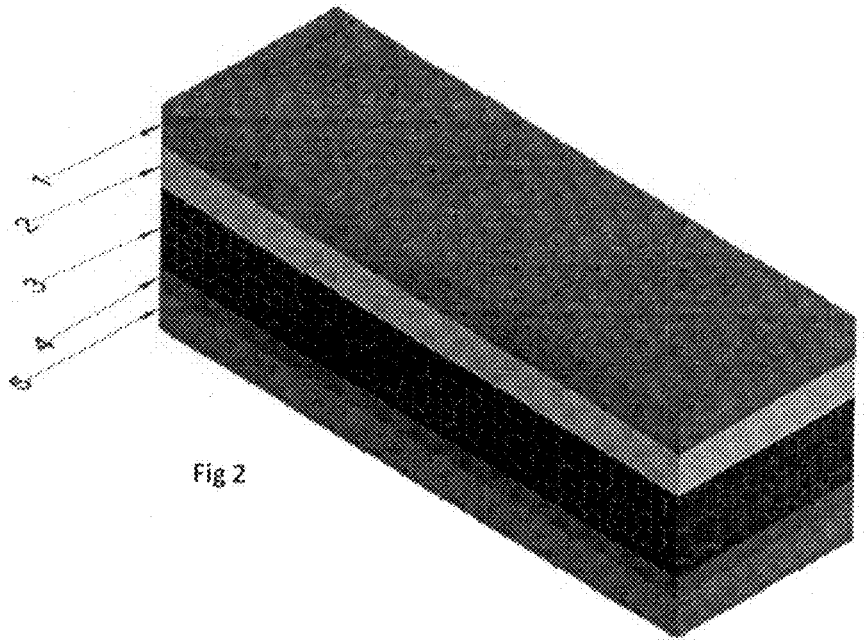
FIG. 2: A cross-sectional three-dimensional magnified view of the modified dynamic armor system layer for a tank.
Figure 3:
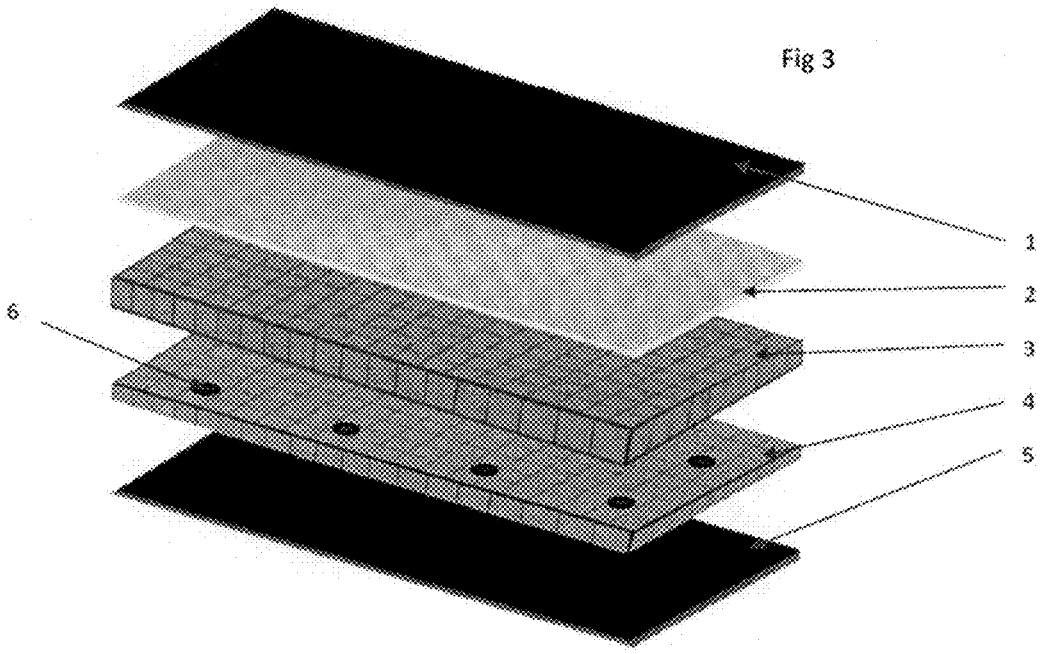
FIG. 3: A cross-sectional three-dimensional view of the modified dynamic armor system layers for the tank, with all parts removed, showing in detail the packaging of the ferromagnetic powder in cubes or the use of a cubic lattice structure.
Figure 4:
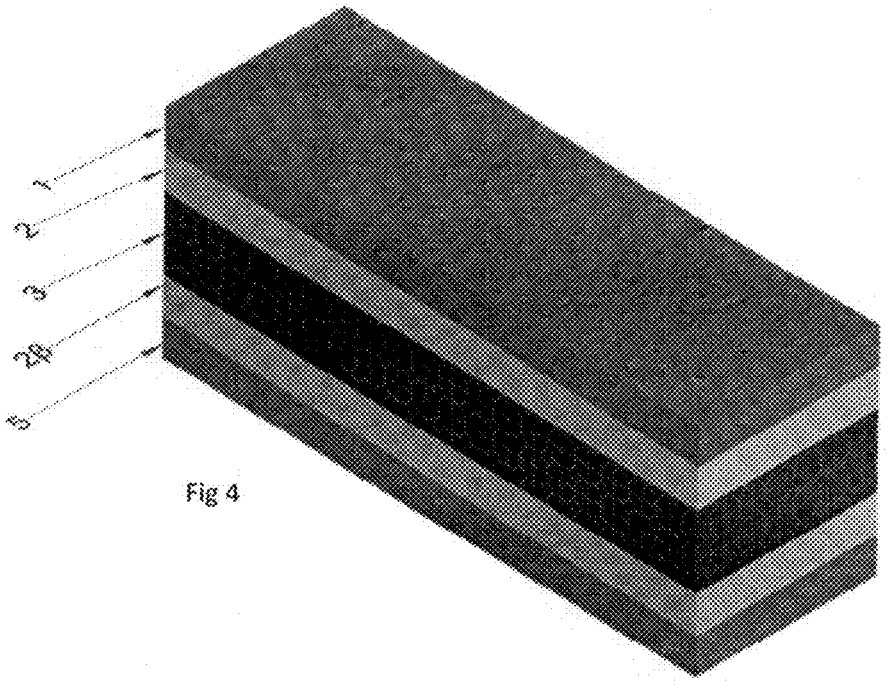
FIG. 4: A cross-sectional three-dimensional magnified view of the modified dynamic armor system layers for the tank, where the explosive layer has been replaced by a high-temperature silicone layer.
Figure 5:
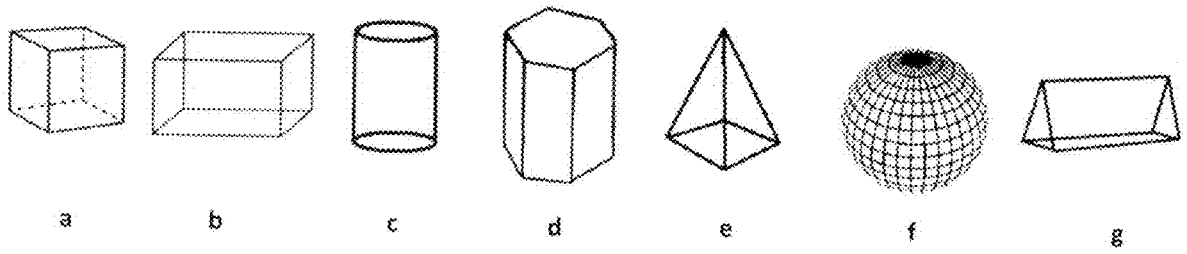
FIG. 5: Presents indicative unit geometric three-dimensional shapes that can be used for the distribution of ferromagnetic powder or the construction of a lattice structure.

The dynamic armor system comprises three levels of reinforcement using electromagnetically reinforced compressed ferromagnetic powder:

1. First Level: A high-temperature silicone layer is placed between outer and inner passive solid armor plates, designed to absorb thermal energy during missile impact.
2. Second Level: Ferromagnetic powder distributed in geometric shapes (pellets, cubes) within polymeric materials is compressed between the armor plates, ensuring durability.
3. Third Level: A layer of explosive material, activated by sensors, neutralizes projectiles upon penetration.

The armor system is designed to protect military vehicles against modern anti-tank projectiles and can be adapted for use in body armor.

In a preferred embodiment, the dynamic armor is for tanks and battle vehicles and uses electromagnetically reinforced compressed ferromagnetic powder, the armor including:

an outer solid passive armor plate 1 and an inner solid passive armor plate 5;

electromagnetic coils 7;

a layer containing compressed ferromagnetic powder 3; and a layer of high-temperature silicone 2 with a thickness proportional to the expected threat, located between the outer solid passive armor plate and the compressed ferromagnetic powder;

wherein the layer containing compressed ferromagnetic powder is defined by a distribution of ferromagnetic powder contained in pellets, cubes, rectangular parallelepipeds, or other geometric volumes of polymeric material, or alternatively, the layer containing compressed ferromagnetic powder is defined by a spatial network with cubic, conical, or spherical divided distribution volumes with walls made of polymeric material with viscoelasticity;

wherein the layer containing the ferromagnetic powder is compressed between the outer solid passive armor plate and the inner solid passive armor plate.

The armor can further include a layer of explosive 4 between the inner solid passive armor plate and the layer containing compressed ferromagnetic powder, with sensors 6 in communication with the electromagnetic coils. The layer of explosive can be a single layer.

The armor can further include another layer of high-temperature silicone.

The armor is also applicable to armor plates of body armor, or other armored constructions.

The invention claimed is:

1. Dynamic armor for tanks and battle vehicles using electromagnetically reinforced compressed ferromagnetic powder, comprising:

an outer solid passive armor plate and an inner solid passive armor plate;

electromagnetic coils;

a layer containing compressed ferromagnetic powder; and a layer of high-temperature silicone with a thickness proportional to the expected threat, located between the outer solid passive armor plate and the compressed ferromagnetic powder;

wherein the layer containing compressed ferromagnetic powder is defined by a distribution of ferromagnetic powder contained in pellets, cubes, rectangular parallelepipeds, or other geometric volumes of polymeric material, or alternatively, the layer containing compressed ferromagnetic powder is defined by a spatial network with cubic, conical, or spherical divided distribution volumes with walls made of polymeric material with viscoelasticity;

wherein the layer containing the ferromagnetic powder is compressed between the outer solid passive armor plate and the inner solid passive armor plate.

2. The dynamic armor according to claim 1, further comprising a layer of explosive between the inner solid passive armor plate and the layer containing compressed ferromagnetic powder, with sensors in communication with the electromagnetic coils.

3. The dynamic armor according to claim 2, wherein the layer of explosive is a single layer.

4. The dynamic armor according to claim 1, further comprising another layer of high-temperature silicone.

5. The dynamic armor according to claim 1, wherein the dynamic armor is applicable to armor plates of body armor.

6. The dynamic armor according to claim 1, wherein the dynamic armor is applicable to other armored constructions.

* * * * *